US006104306A

United States Patent [19]

Hogue et al.

[11] Patent Number: 6,104,306

[45] Date of Patent: Aug. 15, 2000

[54] CLOSURE-SENSITIVE SIGNALLING DEVICE WITH CANTILEVER SWITCH

[75] Inventors: Timothy D. Hogue, Indianapolis; Edward D. Lewis, Danville, both of Ind.; Raymond W. Leung, Fremont, Calif.

[73] Assignee: Buztronics, Inc., Indianapolis, Ind.

[21] Appl. No.: 09/066,129

[22] Filed: Apr. 24, 1998

Related U.S. Application Data

[60] Provisional application No. 60/074,874, Feb. 17, 1998.

[51] Int. Cl.[7] ..... G08B 21/00

[52] U.S. Cl. ..... 340/686.1; 40/124.1; 40/359; 40/457; 200/457; 200/458; 200/332

[58] Field of Search ..... 340/686.1, 568.7; 40/124.1, 359, 463, 464, 457, 455; 200/6 R, 411, 415, 457, 458, 459, 466, 467, 282, 332, 335

[56] References Cited

U.S. PATENT DOCUMENTS

| | | | |
|---|---|---|---|
| 4,102,067 | 7/1978 | Tarrant | 40/455 |
| 4,299,041 | 11/1981 | Wilson | 40/124.1 |
| 4,357,510 | 11/1982 | Fortuna | 200/283 |
| 4,424,420 | 1/1984 | Haskins | 179/164 |
| 4,607,747 | 8/1986 | Steiner | 206/232 |
| 4,614,266 | 9/1986 | Moorhead | 206/216 |
| 4,791,741 | 12/1988 | Kondo | 40/124.1 |
| 4,866,865 | 9/1989 | Yang | 40/455 |
| 5,063,698 | 11/1991 | Johnson et al. | 40/124.1 |
| 5,258,591 | 11/1993 | Buck | 200/181 |
| 5,275,285 | 1/1994 | Clegg | 206/449 |
| 5,387,108 | 2/1995 | Crowell | 434/319 |
| 5,484,292 | 1/1996 | McTaggart | 434/317 |
| 5,499,465 | 3/1996 | Manico | 40/152 |
| 5,502,463 | 3/1996 | Sasaki et al. | 345/204 |
| 5,761,836 | 6/1998 | Dawson | 40/124.03 |

*Primary Examiner*—Daniel J. Wu
*Assistant Examiner*—Toan Pham
*Attorney, Agent, or Firm*—Woodard, Emhardt, Naughton, Moriarty & McNett

[57] ABSTRACT

A closure-sensitive signalling device with a cantilever switch responsive to the opening of a folded article such as a business card holder, greeting card, folder, or other article having panels foldable with respect to each other along a fold line. The cantilever switch has a stationary electrical contact and a conductive cantilever arm engageable therewith, and is mounted along with a battery-powered signal generator IC on a low-profile printed circuit board adapted for mounting on one panel of the folded article with the cantilever switch adjacent to the fold line. The cantilever arm's free end is engageable with another panel of the folded article such that the switch is held open when the article is closed and is closed when the article is open. The signalling device generates an audible or visible signal in response to a signal from the signal generator IC.

15 Claims, 9 Drawing Sheets

CLOSURE-SENSITIVE SIGNALLING DEVICE WITH CANTILEVER SWITCH

CROSS-REFERENCE TO RELATED APPLICATION

This application claims the benefit of U.S. Provisional Application Ser. No. 60/074,874, filed Feb. 17, 1998.

BACKGROUND OF THE INVENTION

This application relates to closure-sensitive devices and, more particularly, to devices which generate an audible or visible signal in response to the opening of a folded article.

Articles of this type have been produced in the past, especially in the field of greeting cards. Other such articles produced or at least proposed in the past include business card holders, folders, advertising and promotional literature, and product packaging, among others, as indicated in the following patents:

| U.S. Pat. No. | Inventor | Issue Date |
|---|---|---|
| 4,102,067 | Tarrant | Jul. 25, 1978 |
| 4,299,041 | Wilson | Nov. 10, 1981 |
| 4,607,747 | Steiner | Aug. 27, 1986 |
| 4,614,266 | Moorhead | Sep. 30, 1986 |
| 5,275,285 | Clegg | Jan. 4, 1994 |
| 5,387,108 | Crowell | Feb. 7, 1995 |

A common form of switch mechanism used in such articles is a slide tongue mechanism of the type disclosed in the above-referenced U.S. Pat. No. 4,607,747 to Steiner, U.S. Pat. No. 5,275,285 to Clegg, and U.S. Pat. No. 5,387,108 to Crowell. Slide tongue mechanisms have two electrical contacts biased toward each other but held apart by an insulating pull-tab or tongue. The mechanism is typically mounted with the tongue straddling a fold line in a folded article such that the tongue slides out from between the contacts enough to allow the contacts to close when the article is opened. Such mechanisms are fairly simple and inexpensive but tend to be susceptible to failure after long storage of the article in its closed position. More specifically, it is thought that the wedge force applied by the tongue can create a permanent gap between the contacts when the article is stored in its closed position, as it normally is, for a long period of time.

Light-sensitive switch mechanisms have also been proposed, such as disclosed in the above-referenced U.S. Pat. No. 4,299,041 to Wilson. However, articles employing such switch mechanisms have to be carefully designed to avoid inadvertent circuit actuation in response to ambient light.

Another prior art switch mechanism, designed for use in a business card holder, is shown in FIGS. 1 and 2. A closure-sensitive sound module 10 which includes a printed circuit (pc) board 12 and a speaker 14 is mounted on an inner surface 16 of an outer layer 18 of a double-layer panel 20 of a folding business card holder 22 which has a second double-layer panel 24 foldable with respect to panel 20 along a fold line 26. Four slots 28 are provided in an inner layer 30 of panel 24 for receiving and retaining a business card. Layers 18 and 19 of panel 20 are substantially parallel to each other and thereby together define a sleeve or thin pocket therebetween within which sound module 10 is enclosed. Circuit board 12 has a signal generator IC 32 that is powered by a button-cell battery 34 and triggered by closure of a cantilever switch 36, which includes a conductive cantilever arm 38 with a free end 40 which is exposed to contact with layer 30 via a notch 42 provided in layer 19 for this purpose. Switch 36 is normally closed but is held open by panel 24 bearing against free end 40 of cantilever arm 38 when the card holder is closed.

Cantilever arm 38 is attached at a single point 44 on the underside of the pc board and is biased upwardly toward a stationary electrical contact 46 mounted on the pc board's top surface 48. When the card holder is opened, the free end of arm 38 is released and thereby moves upwardly such that the switch closes. The IC is designed to respond to the switch closure by generating a signal which, when supplied to the speaker, produces a ringing telephone sound. Cantilever arm 38 is a leaf spring of nickel-plated spring steel having a thickness of 0.006", a width of 0.040", and a length of ¾" from the attachment point 44 to the tip of the free end. A perpendicular tab 50 is provided on the attachment end of the arm 38, the attachment end including a rectangular plate portion shown in phantom in FIG. 2A. During assembly of the switch, the tab is inserted through a hole provided for this purpose in the pc board and then bent 90° such that a portion thereof lies flush against an electrical terminal on the top surface of the board, as best shown in FIG. 2B, where it is soldered in place, e.g., with a solder bead 52 (removed from FIG. 2A for illustration purposes). Electrical contact 46 is similarly secured with a pair of solder beads 54. The cantilever arm in this switch mechanism, with its single point of attachment, has been found highly susceptible to permanent deformation upon downward flexing thereof when the card holder is closed, such that it does not reliably close as necessary upon opening the card holder after sustained closure thereof.

Thus, although folded articles with closure-sensitive signalling devices are known to be desirable and various forms thereof are functional for periods of time, there is a continuing need for greater reliability in such articles, and particularly the switch mechanisms therein, while maintaining design simplicity and low cost.

SUMMARY OF THE INVENTION

The present invention provides a closure-sensitive signalling device with a cantilever switch responsive to the opening of a folded article. The cantilever switch has a stationary electrical contact and a conductive cantilever arm engageable therewith, and is mounted along with a battery-powered signal generator IC on a low-profile printed circuit board adapted for mounting on a first panel of the folded article with the cantilever switch on one end of the board adjacent to a fold line between the first panel and a second panel of the folded article. The cantilever arm has a free end which is engageable with the second panel when the printed circuit board is mounted on the first panel with its one end adjacent to the fold line. The signalling device includes a transducer for generating an audible or visible signal in response to a signal from the signal generator IC.

According to one aspect of the invention, a fulcrum for a cantilever switch is defined on the top surface of the printed circuit board, and one end of the cantilever arm is secured to the board and engaged with the fulcrum on the top surface thereof.

Another aspect of the invention involves a cantilever arm spring biased toward the stationary contact. Spring biasing is provided in the preferred embodiment with a coil spring integrally formed with the cantilever arm, which is constructed of spring wire.

It is a general object of the present invention to provide improvements in closure-sensitive signalling devices at low cost.

Another object of the present invention is to provide greater reliability in such devices while maintaining design simplicity and low cost.

These and other objects and advantages of the present invention will be more apparent from reading the following detailed description of the preferred embodiment in conjunction with the accompanying drawings.

DETAILED DESCRIPTION OF THE PREFERRED EMBODIMENT

Figure 1:
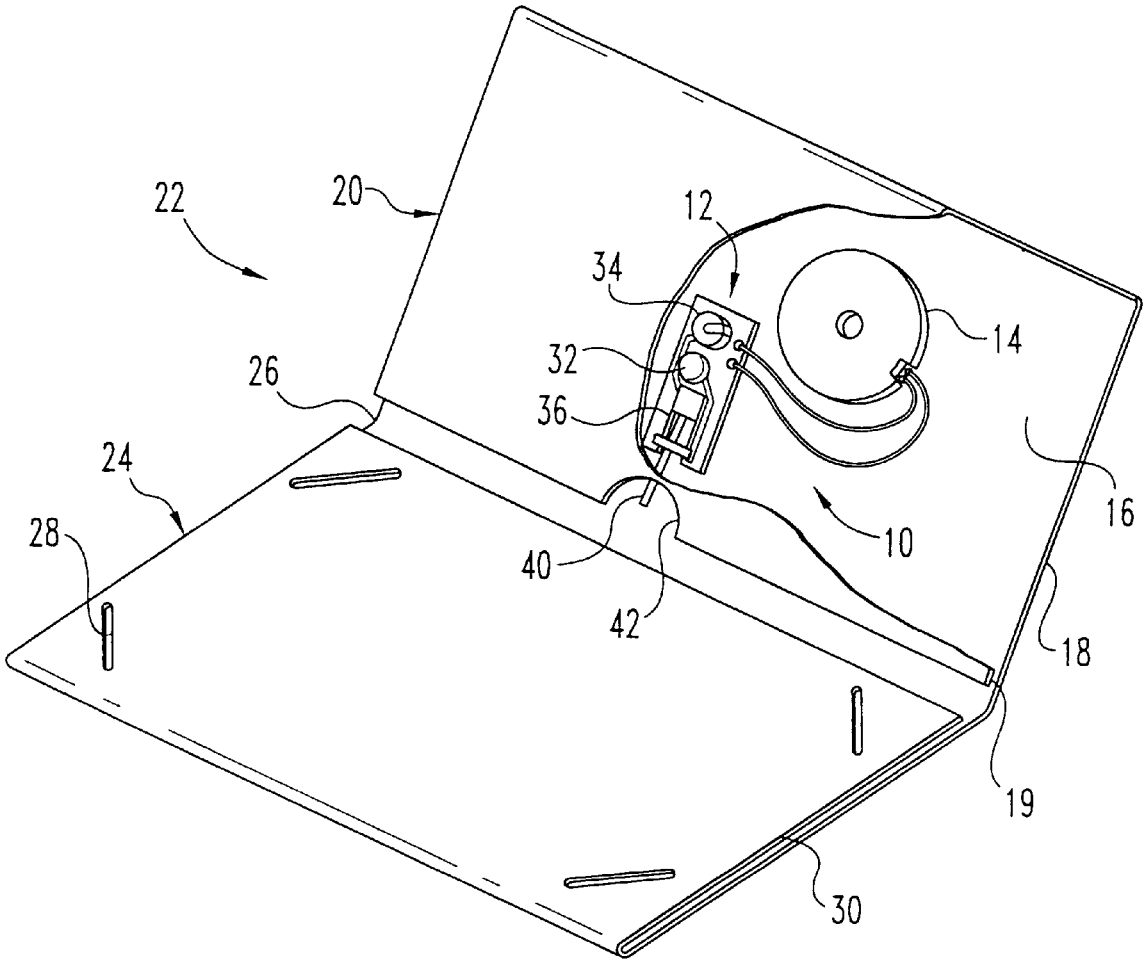
Fig. 1 (PRIOR ART)
FIG. 1 is a perspective view of a prior art business card holder, with a portion of one panel removed to reveal a closure-sensitive sound module mounted therein.
Figure 2A:
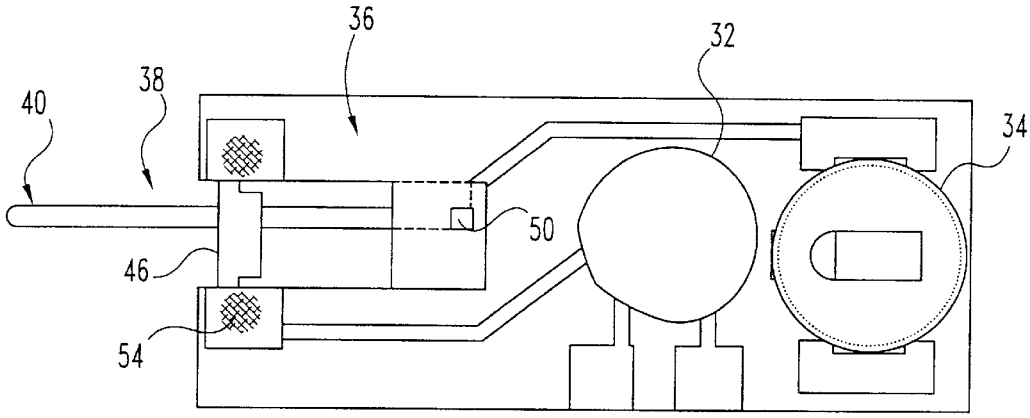
Fig. 2A (PRIOR ART)
FIGS. 2A and 2B are top and side views, respectively, of the circuit board shown in FIG. 1.
Figure 2B:
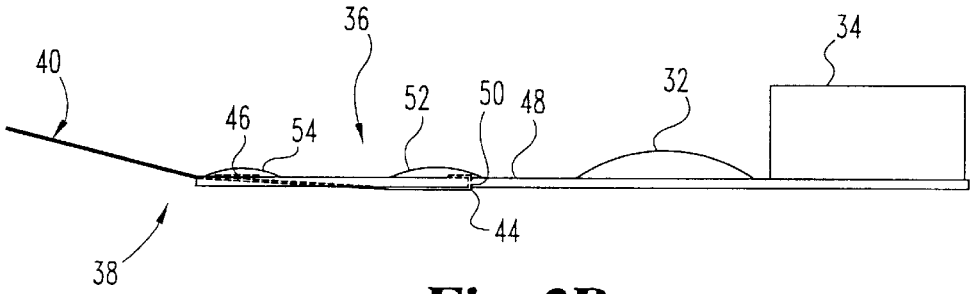
Fig. 2B (PRIOR ART)

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
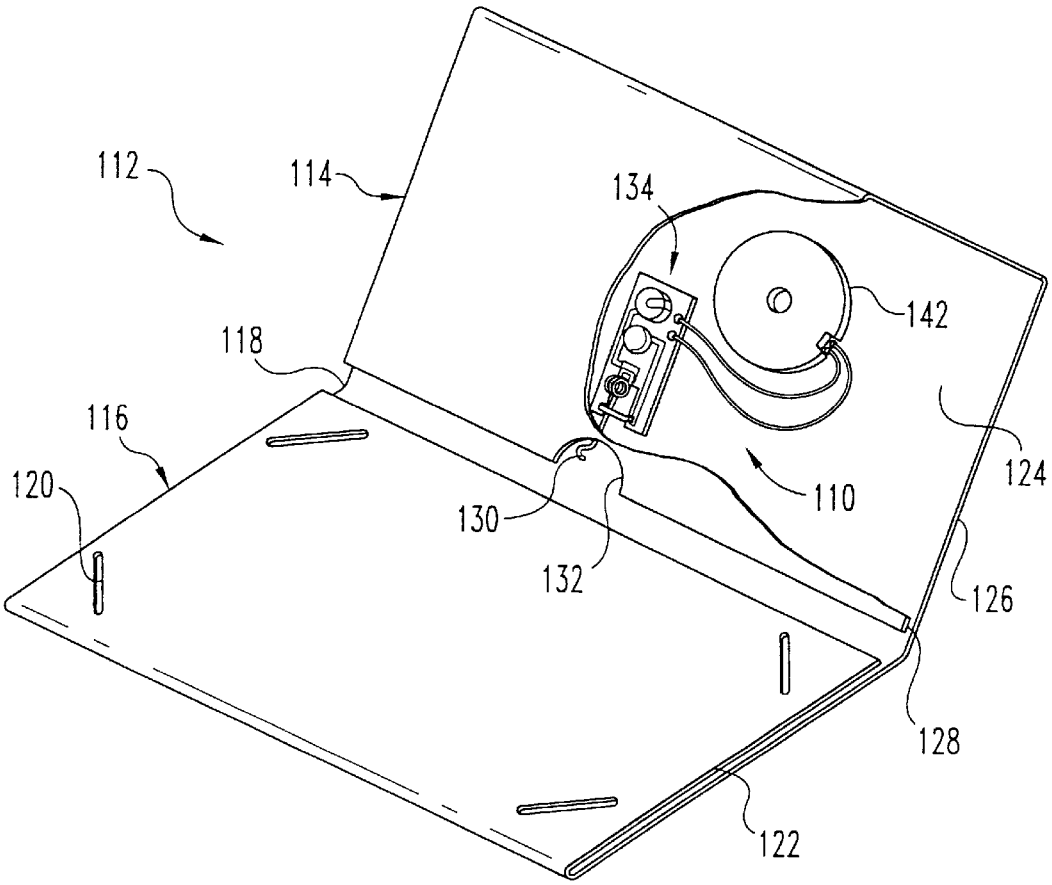
FIG. 3 is a perspective view of a business card holder with a portion of one panel removed to reveal a closure-sensitive signalling device according to a first embodiment of the present invention.

FIG. 3 shows a first embodiment of a closure-sensitive signalling device 110 according to the present invention within a business card holder 112 which has two double-layer panels 114 and 116 which are foldable with respect to each other along a fold line 118. The business card holder is provided in a conventional manner with slots 120 in an inner layer 122 of panel 116 for receiving and retaining a business card. Closure-sensitive signalling device 100 is mounted on the inner surface 124 of an outer layer 126 of panel 114 and covered by the inner layer 128 of that panel except for a switch hook on its free end 130. A notch 132 is provided in layer 128 so as to expose the switch hook to contact with the facing layer 122 when the business card holder is closed.

Figure 4:
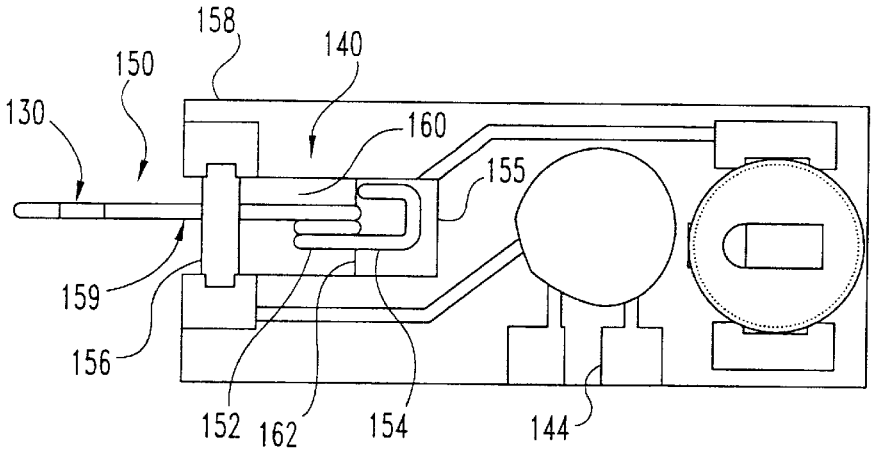
FIG. 4 is a top view of the circuit board of FIG. 3.

The signalling device in this embodiment is a sound module and, as shown in FIGS. 4 and 5, preferably comprises a printed circuit board 134 on which a signal generator IC 136, a button-cell battery 138, and a cantilever switch 140 are all mounted and electrically interconnected, and also comprises a speaker 142 connected to the signal generator IC, via contact terminals 144 formed on the printed circuit board, in order to convert signals from the IC to an audible melody or other message when the circuit is activated via the switch. The IC is correspondingly programmed in a conventional manner, and is preferably a surface-mounted device having a height (as viewed in FIG. 5) of about 2 mm. The printed circuit board preferably has a thickness of 0.032". The printed circuit board and speaker may be adhesively mounted on layer 126 or attached thereto with double-sided tape.

Cantilever switch 140 comprises a cantilever arm 150 which includes a hook on its free end 130 and preferably also includes a 3.3 mm diameter coil spring 152 on the end 154 of the arm which is mounted on the printed circuit board. As shown in FIG. 4, the attachment end 154 of the cantilever arm is U-shaped in this embodiment for firm mounting on the upper surface of the board. The attachment end may be soldered in place on an electrical terminal surface or pad 155 provided on the board surface. Alternatively, the attachment end of the cantilever arm may be provided with a 90° bend for insertion into a hole provided in the pc board for mounting purposes. The cantilever arm, with the coil spring on its attachment end, is formed of 0.015 inch (0.4 mm) diameter nickel-plated beryllium copper wire in this embodiment and is formed such that it is biased toward a stationary electrical contact 156 in the form of a raised bridge on the end 158 of the pc board. Thus the center portion 159 of the arm engages contact 156. Most preferably the cantilever arm is plated with 24 k gold. A die-cut opening 160 is provided in the pc board to allow downward deflection of the cantilever arm, and the edge of the opening defines a fulcrum 162 for the cantilever arm.

Figure 5A:
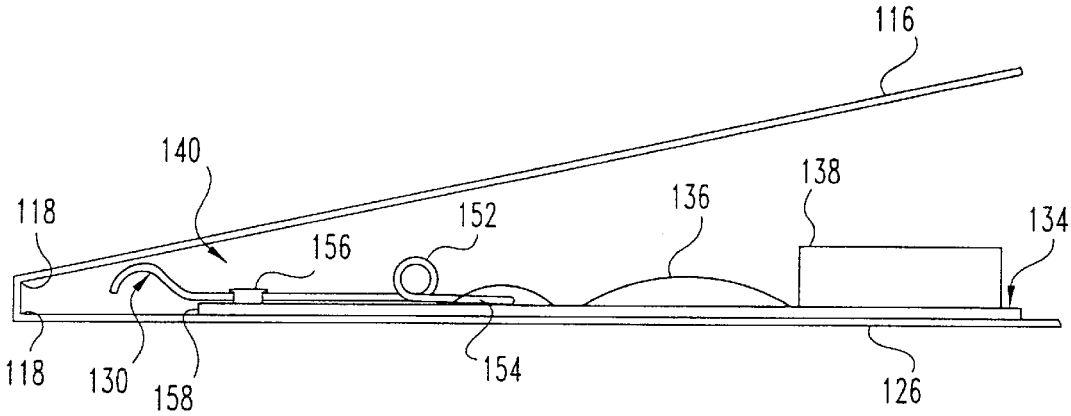
FIGS. 5A and 5B are side views of the circuit board of FIG. 4 within a cross-sectional side view of adjacent portions of the business card holder.
Figure 5B:
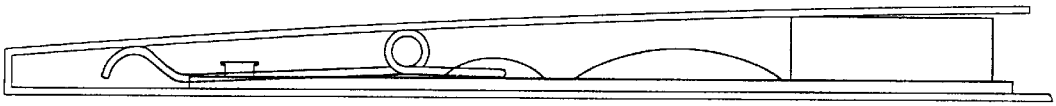

FIGS. 5A and 5B illustrate the circuit board positioned on outer layer 126 of panel 114 and include a simplified illustration of panel 116 as a single-layer panel which is connected to panel 114 via a double crease or fold line 118 about which the two panels can be folded. A spacing of 2 mm between the two fold lines is suitable for this embodiment, and the hook suitably extends 2 mm above the center portion of the arm. With the panels folded together such that the card is closed, panel 116 presses the switch hook down (in the view of FIG. 5B) toward panel 114 and thereby holds the cantilever arm away from the raised bridge. With the cantilever switch in this open position, the sound module is inactive. When the card holder is opened sufficiently to separate panels 14 and 16 as shown in FIG. 5A, the switch hook is released and thereby returns to its normal position as shown in that drawing, in which position the center portion of the cantilever arm contacts the raised bridge and thereby closes the switch. Initial closure of the switch triggers the signal generator IC, which responds by generating an analog signal and supplying that signal to the speaker, which converts the signal to sound.

Figure 6:
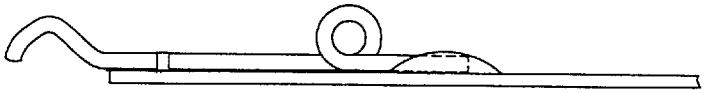
FIG. 6 is a side view of an alternative embodiment of a switch mechanism for a closure-sensitive signalling device according to the present invention.

The switch mechanism embodiment of FIG. 6 is essentially the same as that in FIGS. 3–5, the difference being that the cantilever arm is formed of 0.031 inch (0.8 mm) diameter nickel-plated spring brass or spring steel wire. The raised bridge and the cantilever arm are preferably designed and arranged such that the center portion of the cantilever arm is just above and parallel to the top surface of the printed circuit board.

Figure 7:
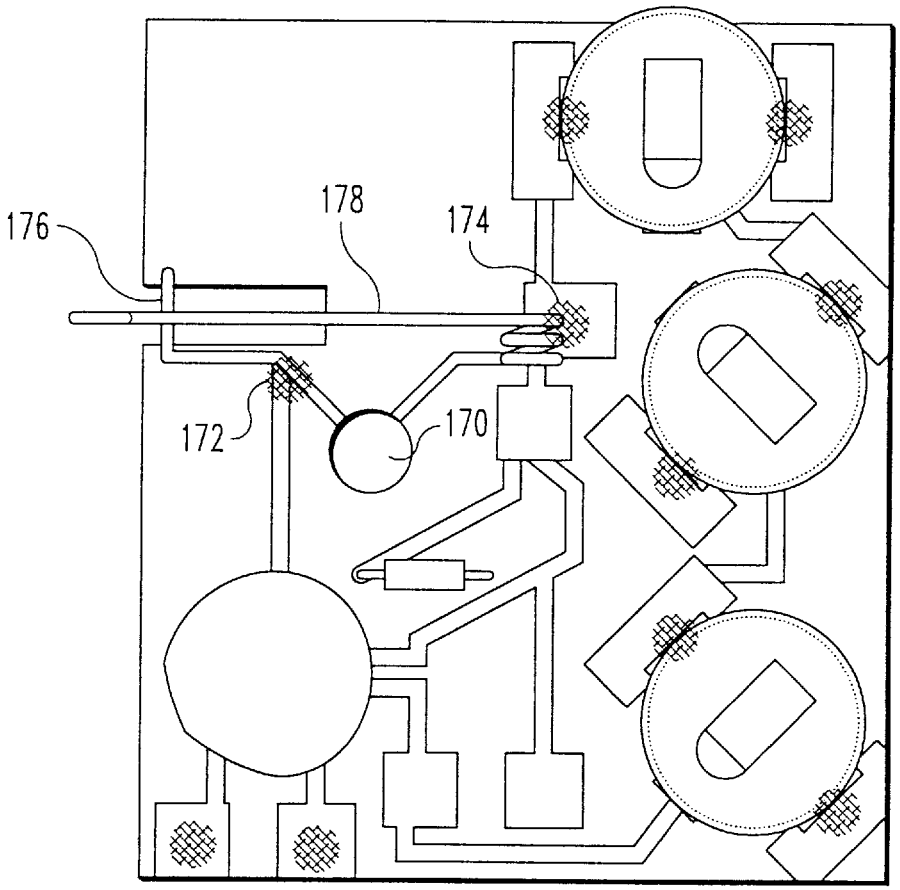
FIG. 7 is another alternative embodiment of a switch mechanism on a circuit board for a closure-sensitive signalling device according to the present invention.
Figure 8A:
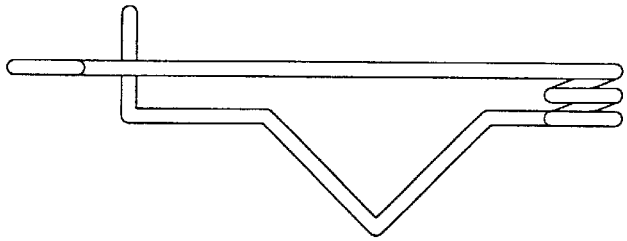
FIGS. 8A, 8B and 8C are top, side and end views, respectively, of an integrally formed switch contact set for the switch mechanism of FIG. 7.
Figure 8C:
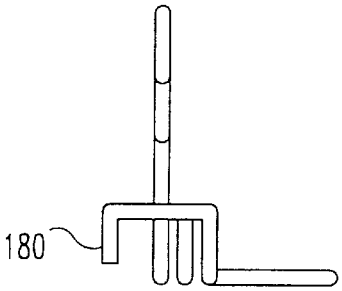
Figure 8B:
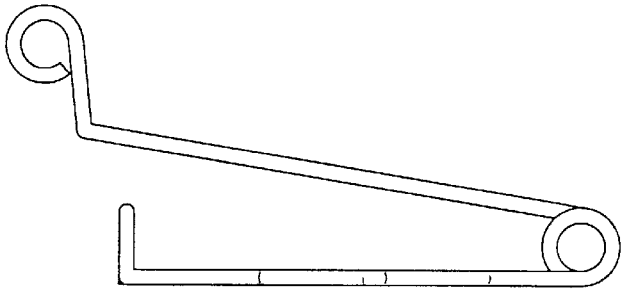
Figure 9:
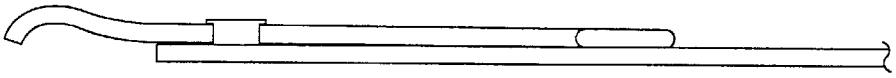
FIG. 9 is a side view of another switch mechanism embodiment.

As shown in FIGS. 7 and 8, a switch mechanism according to the present invention most preferably comprises a pair of switch contacts integrally formed together as a single component, drawn to scale in FIGS. 8A, 8B, and 8C, and then, after mounting thereof on the circuit board, separated by means of a hole 170 punched through a portion thereof and through the circuit board on which the contact set is mounted. This unitary construction of the switch contact set has been found to facilitate proper alignment of the switch contact on the circuit board during assembly. More specifically, solder is applied at two points 172 and 174 to secure the contact set in place on the circuit board and then, by means of a punch press or otherwise, a hole is punched through a corner in the contact set between the two solder junctions to divide the contact set into two separate contacts 176 and 178 which are secured in place by their respective solder beads, as shown in FIG. 7.

The cantilever arm 178 and the entire contact set are preferably formed of spring steel wire 0.4 mm in diameter and gold plated. The diameter of the coil is preferably 2 mm, and the free end of the cantilever arm is preferably provided with a circular shape of 2 mm diameter as shown in FIG. 8B. The cantilever arm suitably has a total horizontal span of 16 mm from the extreme left to extreme right in FIG. 8A. One leg 180 of contact 276, which is formed as a raised bridge as shown, is preferably about 0.5 mm shorter than the opposite leg to provide a gap below leg 180, as shown in FIG. 8C, to enable the cantilever arm to be passed through the gap and into its normal operating position under the bridge after mounting thereof on the printed circuit board. The switch contacts are gold plated to provide significantly better electrical contact. The closed circular shape on the free end of the cantilever arm has been found beneficial in inhibiting the tendency of switch contact sets to hook onto to each other when placed together in a bin during or after processing thereof.

Turning now to the embodiments of FIGS. 9–13, a cantilever arm without a coil spring on its attachment end may be suitable in some applications. The cantilever arm in the embodiment of FIGS. 9 and 10, for example, may be formed of the same 0.031" spring wire as in the embodiment of FIG. 6. The attachment end and switch hook are shaped and sized as shown in the drawing. The bend in the hook suitably extends 0.030" above the rest of the arm as viewed in FIG. 9. A length of 0.6" from the peak of the bend to the opposite end of the arm is suitable for this embodiment as well as for the prior embodiments of this invention and the embodiment of FIG. 10.

Figure 10:
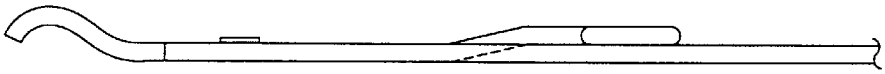
FIG. 10 is a side view of a further switch mechanism embodiment.

In the embodiment of FIG. 10, the cantilever arm has a downwardly offset central portion which extends into the opening provided in the pc board to allow downward deflection of the cantilever arm. In this case the stationary contact extending across the opening is not raised above the plane of the upper surface of the board. The shape of the switch hook is essentially the same as in FIG. 9, but its height above the central portion of the cantilever arm is greater than in FIG. 9, e.g., 0.065", whereby the hook is in essentially the same operating position as in that prior embodiment. The cantilever arm is formed of spring wire of the same type and size as in the prior embodiment.

Figure 11:
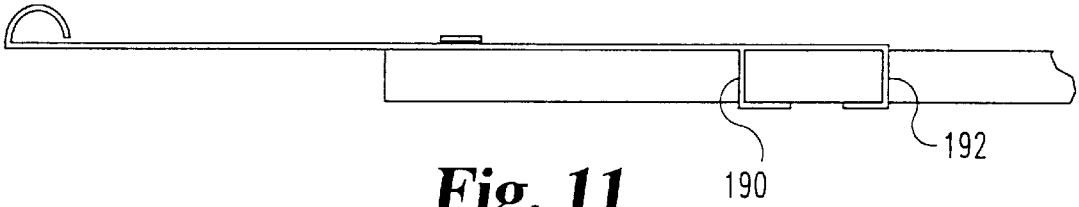
FIG. 11 is a side view of a further switch mechanism embodiment.
Figure 12:
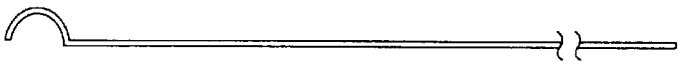
FIG. 12 is a side view of an alternative hook shape for the embodiment of FIG. 11.

FIG. 11 is a cross-sectional side view of a cantilever switch in which the cantilever arm is a thin, flat elongated member, or leaf spring, preferably formed of spring steel. As in the prior embodiments, a bridge contact is provided which extends across the upper surface of the cantilever arm. In this case the bridge has a lower surface lying substantially in the plane of the upper surface of the pc board, which is approximately twice as thick as that of the previous embodiments. The cantilever arm may have a level center portion as shown in FIG. 11 but preferably has a slight upward bend to the left of the bridge, and is attached at two points to the pc board via two downwardly extending tabs 190 and 192 integrally formed on the attachment end of the cantilever arm and secured, e.g., by solder, to a corresponding terminal surface on the board. The attachment end of the cantilever arm in this embodiment has a widened plate portion of a type to be described with reference to FIG. 13. A switch hook variation with a somewhat different shape, which may be suitable for some applications, is shown in FIG. 12.

Figure 13A:
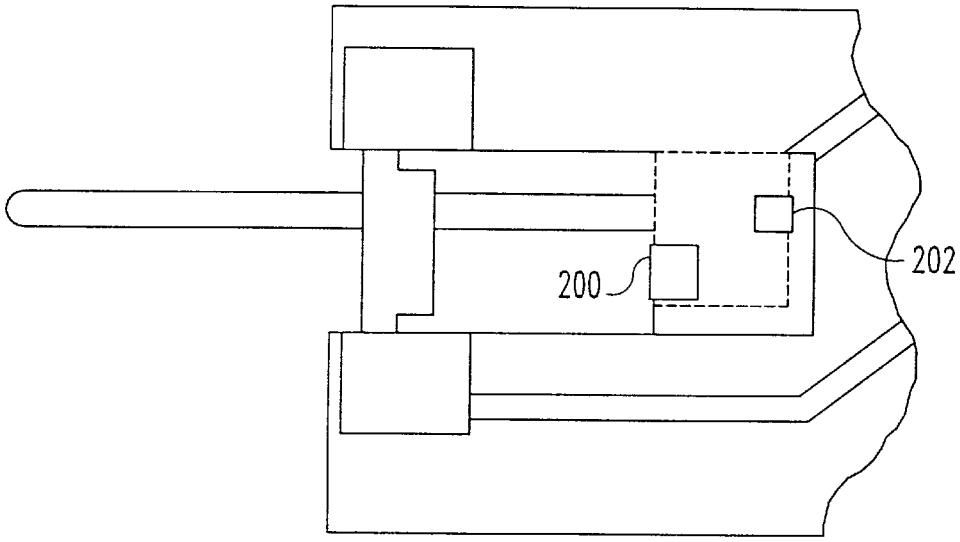
FIGS. 13A and 13B are top and side views, respectively, of a still further alternative embodiment of a switch mechanism according to the present invention.
Figure 13B:
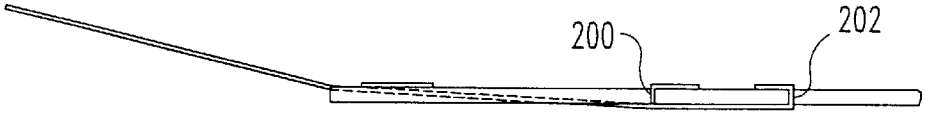

Referring now to the embodiment of a switch mechanism as shown in FIGS. 13A and 13B, a bridge contact is provided at the level of the top surface of the pc board, and a normally closed switch contact is provided in the form of a cantilever arm attached at two points on the underside of the pc board as defined by tabs 200 and 202. The attachment end of the cantilever arm has a widened plate portion shown in phantom in FIG. 13A, with tab 200 extending upward from the edge of the plate portion and past the parallel edge of the printed circuit board, and tab 202 extending upward from an opposite edge of the plate portion and through a hole provided in the pc board for this purpose. The two tabs are bent 900 toward each other on the top surface of the board, as shown in FIG. 13B, and soldered in place.

Figure 14:
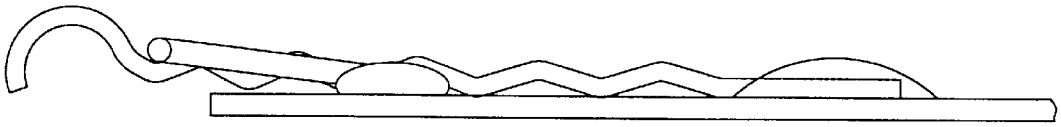
FIG. 14 is a side view of yet another alternative embodiment of a switch mechanism according to the present invention.

FIG. 14 shows an alternative embodiment with a top-side mounted cantilever arm of leaf spring material but provided with a pleated or accordian-like shape as shown from the side in FIG. 14. Gold-plated spring steel of 0.4 mm thickness may be used for the leaf spring, and the stationary contact, which is a raised bridge as can be seen in FIG. 14, is suitably constructed of 0.8 mm gold-plated spring steel. With the construction as shown and with a double-crease card holder with a 2 mm spacing between the creases as described above, a hook having a bend spanning a vertical distance of 2.5 mm (as viewed in FIG. 14) may be employed.

Figure 15:
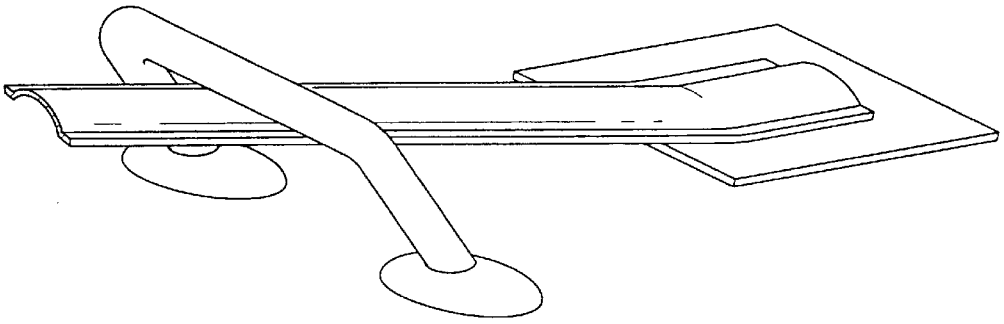
FIG. 15 is an illustration of a still further alternative embodiment of the switch mechanism.

The angled bridge construction of FIG. 14 is shown in further detail in FIG. 15, a perspective view of another alternative embodiment. In this embodiment, the cantilever arm is formed of leaf spring material but is provided with a longitudinal ridge to provide increased resistance to permanent deformation during bending of the type encountered during operation. The angled bridge construction as shown in FIG. 15 is also considered desirable for other embodiments of the invention as described above, including in particular that of FIGS. 4 and 5, in which case the bridge is in virtual contact with the hook on the end of the arm ir the same way that it is in the embodiment of FIG. 14.

With a sound module in which a telephone ringing sound is generated, the circuit preferably is designed to generate three rings and then stop. Instead of or in addition to an audible signal, the signalling device may have one or more LEDs or other miniature light sources, and the IC may be configured such that the light sources flash or create some desired multi-source lighting effect.

Suitable integrated circuits for signalling devices described above are commercially available from, e.g., Mosel Vitelic and New Japan Radio Company, Ltd. More specifically, a Mosel Vitelic VM2189 melody chip may be employed as may other chips in the VM series. Also suitable is a New Japan Radio NJU502 melody chip in die form with 0.02 microamp typical standby current.

The two layers of each panel are preferably adhesively attached at the periphery on each side thereof, and the sleeve within which the signalling device is contained is preferably but not necessarily sealed on all sides except for the notch through which the free end of the cantilever arm is exposed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, although a cantilever switch according to the present invention is preferably a normally closed switch, a normally open switch configuration is also contemplated, e.g., with a cantilever arm positioned above the stationary contact and biased away from such contact. Those skilled in the art will appreciate from the foregoing description that a coil spring may be provided on the attachment end of a cantilever arm in such a manner as to provide such an upward spring bias contained within a folded article such as a card holder. Such a switch is held closed when the folded article is closed and opens upon opening of a folded article, thereby triggering a correspondingly programmed signal generator IC.

It is also contemplated that a switch mechanism of non-cantilever construction, e.g., a pivotally mounted lever, may be suitable in certain applications. A lever arm may be positioned below a bridge contact as described above and biased toward the bridge contact with an external spring or other biasing means.

It is also contemplated that a closure-sensitive signalling device according to the present invention may be supported in a folded article other than on a printed circuit board. For example, a layer of paper stock may itself serve as the supporting surface for a switch, e.g., with conductive ink and a stationary contact printed directly on the paper stock and with a lever arm pivotably or cantilever mounted thereon. Also, the two switch contacts are preferably but not necessarily supported by the same layer of the panel. In general, paper stock with a thickness of approximately 0.010" is suitable for card holder applications, and a UV coating on the paper stock is desirable in such an application.

Closure-sensitive signalling devices of the type described above have a number of different applications, including business card holders, greeting cards and folders as mentioned above, and also magazines, catalogs, brochures, and flip-up point-of-purchase displays. Other applications include CD containers, jewelry boxes, and more generally a variety of product packaging comprising a box with a movable flap or lid, e.g., video cassette cases, software cases, and cereal boxes.

What is claimed is:

1. A closure-sensitive signalling device responsive to the opening of a folded article having first and second panels foldable with respect to each other along a fold line, comprising:

a low-profile printed circuit board having a top surface and a bottom surface and adapted to have said bottom surface secured to said first panel with one end of said board adjacent to said fold line;

a battery-powered signal generator IC mounted on said top surface of said board;

means for generating a humanly perceptible signal in response to a signal from said signal generator IC; and a cantilever switch mounted on said one end of said board and electrically connected to said signal generator IC, said cantilever switch having a fulcrum on said top surface of said board and including a stationary electrical contact mounted on said board; and a conductive cantilever arm engageable with said stationary contact, said cantilever arm having one end secured to said board and engaged with said fulcrum on said top surface thereof, and a free end which is engageable with said second panel when said board is mounted on said first panel with said one end adjacent to said fold line.

2. The closure-sensitive signalling device of claim 1, wherein said stationary contact is mounted above said top surface of said board and said cantilever arm extends below said stationary contact.

3. The closure-sensitive signalling device of claim 2, wherein said cantilever arm includes an integral coil spring.

4. The closure-sensitive signalling device of claim 3, wherein said cantilever arm is longer than the distance between said stationary contact and said fulcrum.

5. The closure-sensitive signalling device of claim 4, wherein said one end of said cantilever arm extends downward through said top surface of said board.

6. A closure-sensitive signalling device responsive to the opening of a folded article having first and second panels foldable with respect to each other along a fold line, comprising:

a low-profile printed circuit board having a top surface and a bottom surface and adapted to have said bottom surface secured to said first panel with one end of said board adjacent to said fold line;

a battery-powered signal generator IC mounted on said top surface of said board;

means for generating a humanly perceptible signal in response to a signal from said signal generator IC; and a cantilever switch mounted on said one end of said board and electrically connected to said signal generator IC, said cantilever switch including a stationary electrical contact mounted on said board;

a conductive cantilever arm engageable with said stationary contact, said cantilever arm having one end secured to said board and a free end which is engageable with said second panel when said board is mounted on said first panel with said one end adjacent to said fold line; and spring means including a coil spring integrally formed with said cantilever arm for biasing said cantilever arm toward said stationary contact.

7. The closure-sensitive signalling device of claim 6, wherein said spring means includes a coil spring integrally formed with said cantilever arm.

8. The closure-sensitive signalling device of claim 6, wherein said stationary contact is mounted above said top surface of said board and said cantilever arm extends below said stationary contact.

9. A closure-sensitive signalling device responsive to the opening of a folded article having first and second panels foldable with respect to each other along a fold line, comprising:

a low-profile printed circuit board having a top surface and a bottom surface and adapted to have said bottom surface secured to said first panel with one end of said board adjacent to said fold line;

a battery-powered signal generator IC mounted on said top surface of said board;

means for generating a humanly perceptible signal in response to a signal from said signal generator IC; and a cantilever switch mounted on said one end of said board and electrically connected to said sound generator IC, said cantilever switch including a stationary electrical contact mounted on said board; and a conductive cantilever arm of spring wire engageable with said stationary contact, said cantilever arm having one end secured to said board and a free end which is engageable with said second panel when said board is mounted on said first panel with said one end adjacent to said fold line.

10. The closure-sensitive signalling device of claim 9, wherein said cantilever arm includes an integral coil spring.

11. A folded card with a closure-sensitive signalling device, comprising:

first and second panels of paper stock folded with respect to each other along a fold line, said first panel having inner and outer substantially parallel layers defining a sleeve therebetween; and a signalling device including a switch contained within said sleeve, said signalling device including a stationary electrical contact and a conductive lever arm supported by one of said layers, said lever arm having an attachment end, a center portion engageable with said stationary contact, and a free end extending out of said sleeve and engageable with said second panel, said lever arm including an integral coil spring, said signalling device further including a battery-powered signal generator IC having an input connected to said switch, and means for generating a humanly perceptible signal in response to a signal from said signal generator IC.

12. The folded card of claim 11, wherein said signalling device includes a switch base adhesively attached to said outer layer of said first panel, and wherein said stationary contact and said lever arm are mounted on said base.

13. The folded card of claim 12, wherein said switch base includes a top surface, and said stationary contact is mounted above said top surface of said base.

14. The folded card of claim 12, wherein said switch base defines a fulcrum for said lever arm, and the horizontal distance from said fulcrum to said stationary contact is greater than the horizontal distance from said stationary contact to the tip of said free end.

15. A closure-sensitive signalling device responsive to the opening of a folded article having first and second panels foldable with respect to each other along a fold line, comprising:

a low-profile printed circuit board adapted for mounting on said first panel with one end of said board adjacent to said fold line;

a battery-powered signal generator IC mounted on said printed circuit board;

means for generating a humanly perceptible signal in response to a signal from said signal generator IC; and a cantilever switch mounted on said one end of said printed circuit board and electrically connected to said signal generator IC, said cantilever switch including a stationary electrical contact fixed in place on said printed circuit board; and a conductive cantilever arm engageable with said stationary contact, said cantilever arm having one end secured at more than one point on e surface of said printed circuit board, said cantilever arm further having a free end which is engageable with said second panel when said printed circuit board is mounted on said first panel with said one end adjacent to said fold line.

* * * * *